United States Patent [19]

Melton

[11] Patent Number: 4,945,576

[45] Date of Patent: Aug. 7, 1990

[54] SHOULDER PAD AND BRASSIERE STRAP CUSHION APPARATUS

[76] Inventor: Ardella R. Melton, 1647 W. Pima, Phoenix, Ariz. 85007

[21] Appl. No.: 393,273

[22] Filed: Aug. 14, 1989

[51] Int. Cl.[5] ..... A41D 27/26

[52] U.S. Cl. ..... 2/268; 2/2; 450/86

[58] Field of Search ..... 2/2, 268; 450/86

[56] References Cited

U.S. PATENT DOCUMENTS

| | | | |
|---|---|---|---|
| 1,631,694 | 6/1927 | Rick | 450/86 X |
| 2,505,272 | 4/1950 | Blalock et al. | 450/86 X |
| 2,587,101 | 2/1952 | Blalock et al. | 2/2 |
| 2,615,172 | 10/1952 | Donegan | 2/2 X |
| 2,637,849 | 5/1953 | Nelson | 2/2 |
| 2,643,380 | 6/1953 | Blair | 2/2 |
| 2,654,887 | 10/1953 | Hookstratten | 2/2 |
| 3,050,734 | 8/1962 | Dopyera | 2/268 |
| 3,154,787 | 11/1964 | Newman | 2/2 |
| 3,229,694 | 1/1966 | Koropp | 450/86 |
| 4,472,838 | 9/1984 | Pompa | 2/2 X |
| 4,575,874 | 3/1986 | Johnson | 2/268 |
| 4,612,395 | 9/1986 | Greifer | 450/86 |
| 4,638,513 | 1/1987 | Woods | 450/86 X |
| 4,764,988 | 8/1988 | Reaver | 2/268 |
| 4,795,399 | 1/1989 | Davis | 2/268 X |
| 4,795,400 | 1/1989 | Greenberg | 2/268 X |

FOREIGN PATENT DOCUMENTS

| | | | |
|---|---|---|---|
| 8602646 | 5/1988 | Netherlands | 2/268 |

*Primary Examiner*—Werner H. Schroeder
*Assistant Examiner*—Jeanette F. Chapman
*Attorney, Agent, or Firm*—H. Gordon Shields

[57] ABSTRACT

Combination shoulder pad and brassiere strap cushion (brassiere strap) apparatus includes a pair of panels which fold in the middle. The bra strap is disposed between the two pads and is held in place by fastening elements which secure the two portions of the pads together. When folded, the outer edge of the apparatus comprises a flat line at the outer edge of the shoulder, and extending inwardly from the outer edge is a pair of edges which curve inwardly and terminate at the inside of the user's shoulder, or adjacent to the user's neck.

8 Claims, 1 Drawing Sheet

SHOULDER PAD AND BRASSIERE STRAP CUSHION APPARATUS

BACKGOUND OF THE INVENTION

1. Field of the Invention

This invention relates to padding apparatus and, more particularly, to a combination of shoulder pad and brassiere strap pad.

2. Description of the Prior Art

U.S. Pat. No. 2,505,272 (Blalock et al) discloses a pad for a brassiere (bra) strap. The pad extends generally along the same direction as the brassiere starp and includes two fasteners which cooperate with fastening elements on the brassiere strap to hold the pad in place beneath the strap and on the user's shoulder.

U.S. Pat. No. 2,589,755 (Ward et al) discloses another type of shoulder pad and strap holder in which the pad includes outer edges which curl over on top of the strap. The strap accordingly is held in place beneath the roller over outer edges of the pad.

U.S. Pat. No. 2,763,004 (Sanders) discloses another type of protective pad for a bra strap. The pad apparatus includes clips which bend over the strap to hold the pad in place.

U.S. Pat. No. 2,823,384 (Eilertsen) discloses another type of shoulder strap clasp which extends transversely through a strap. The pad includes a flat portion which folds over the pad portion and extends beneath loops to hold the pad in place relative to the shoulder strap.

U.S. Pat. No. 2,874,468 (De Woskin) discloses an orthodontic device which includes a pad extending beneath an orthodontic traction band. The pad is disposed at the back of the neck of the user.

U.S. Pat. No. 3,229,694 (Koropp) discloses another type of protective pad for a bra strap. The pad extends longitudinally, or aligned with the bra strap, and includes two portions, which bend over and insert between clasped elements on the pads.

SUMMARY OF THE INVENTION

The invention described and claimed herein comprises a combination shoulder pad and brassiere (bra) strap pad which includes two portions. The brassiere strap is disposed on one portion, and the other portion is folded over and secured to the one portion. The two portions, on their inside faces, or on the surfaces which face each other, include fastening elements. The fastening elements hold the bra strap in place. The shoulder pad apparatus is relatively large in that it extends over a substantial length of the bra strap over the shoulder of the user to provide a comfortable and elongated cushion for the bra strap. At the same time, the apparatus comprises fashionable shoulder pads to be worn at the outer portion of the user's shoulder beneath a blouse or dress.

Among the objects of the present invention are the following:

To provide new and useful shoulder pad apparatus;

To provide new and useful brassiere strap cushion apparatus;

To provide new and useful combination shoulder pad and brassiere strap cushion;

To provide new and useful shoulder pad and bra strap cushion having two portions which fold over to define a single apparatus; and To provide new and useful cushioned bra strap apparatus.

DESCRIPTION OF THE PREFERRED EMBODIMENT

Figure 1:
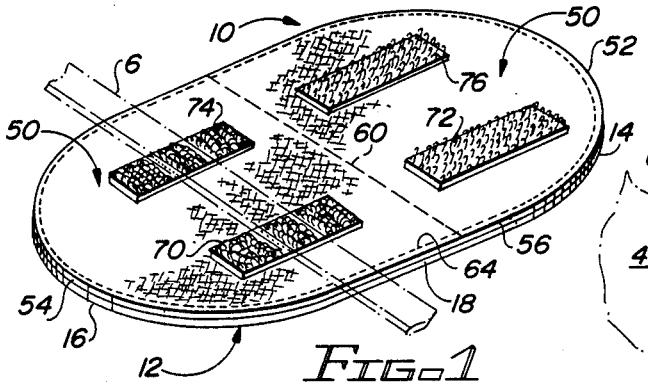
FIG. 1 is a perpective view of the apparatus of the present invention.
Figure 3:
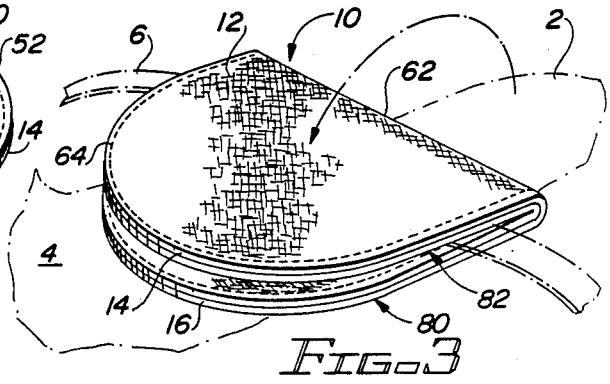
FIG. 3 is a perspective view illustrating the use environment of the apparatus of the present invention.
Figure 2:
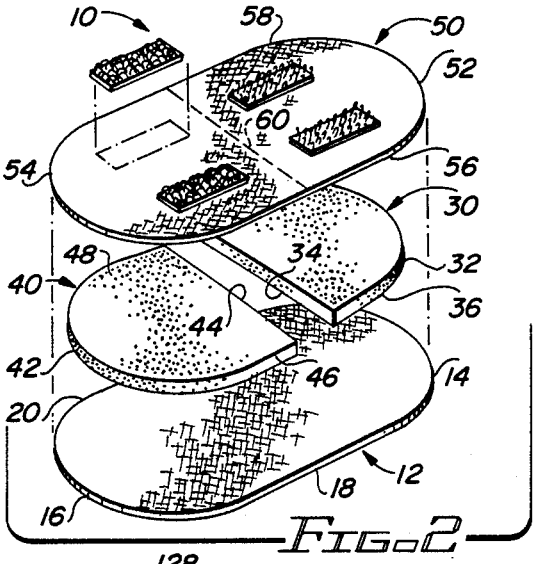
FIG. 2 is an exploded perspective view of the apparatus of the present invention.
Figure 4:
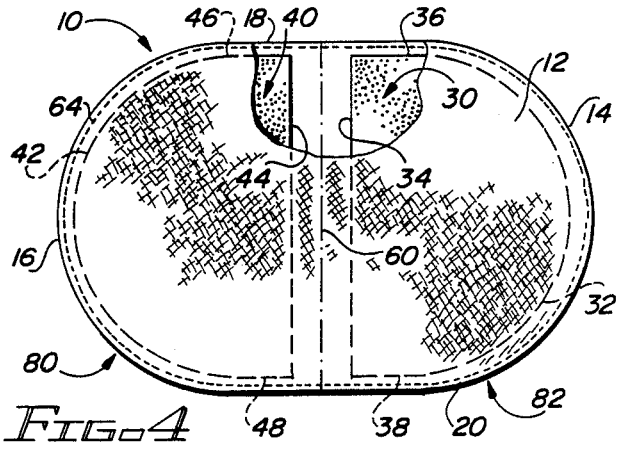
FIG. 4 is a bottom plan view, partially broken away, of the apparatus of FIG. 3.

FIG. 1 is a perspective view of shoulder pad and brassiere strap cushion apparatus 10 of the present invention. FIG. 2 is an exploded perspective view of the apparatus 10. FIG. 3 is a perspective view of the apparatus 10 in its use environment. FIG. 4 is a plan view of the apparatus 10. For the following discussion of the shoulder pad and brassiere (bra) strap cushion apparatus 10, reference will primarily be directed to FIGS. 1, 2, 3, and 4.

The pad and cushion apparatus 10 illustrated in FIGS. 1, 2, 3, and 4, includes an outer layer of fabric 12, an inner layer of fabric 50, and a middle layer comprising a pair of foam cushion inserts 30 and 40 disposed between and appropriately secured to the outer layer 12 and to the inner layer 50. The three layers, outer layer 12, inner layer 50, and the middle layer, which consists of the two foam cushion inserts 30 and 40, are appropriately secured together at the outer periphery of the layers 12 and 50, as illustrated in FIGS. 1, 3, and 4. This will be discussed in detail below.

The outer layer 12 includes a pair of rounded edges, including a rounded edge 14 and a rounded edge 16. The rounded edges 14 and 16 extend to or between a pair of side straight edges 18 and 20.

The inner layer 50 is substantially identical to the outer layer 12 in dimension and in configuration. The inner layer 50 includes a pair of rounded edges 52 and 54, which are aligned with the rounded edges 14 and 16, respectively, of the outer layer 12. The inner layer 50 also includes a pair of straight edges 56 and 58, which are generally aligned, respectively, with the straight edges 18 and 20 of the outer layer 12.

A pair of cushion inserts, preferably some type of elastomeric foam, is disposed between the outer layer 12 and the inner layer 50. The cushion inserts include the cushion insert 30 and the cushion insert 40. The cushion insert 30 includes an outer rounded edge 32, which is generally aligned with the outer curved edges 14 and 52 of the inner and outer layers 12 and 50, respectively.

The cushion insert 30 also includes a relatively straight or square edge 34 which is opposite the curved edge 32. The cushion insert 30 also includes a pair of straight edges, of which a straight edge 36 is shown in FIG. 2. A straight edge 38 is shown in phantom in FIG. 4.

The curved edge 32 extends to the straight edges 36 and 38, and the square edge 34 is disposed between the outer ends of the edges 36 and 38, remote from the curved edge 32. The term "square" simply refers to the fact that the edge 34 is generally perpendicular to the edges or sides 36 and 38.

The cushion or pad 40 is substantially identical to the cushion or pad 30. The cushion insert 40 includes the rounded, outer edge 42, an inner or square edge 44, and a pair of side edges 46 and 48. The curved edge 42 extends to the side edges 46 and 48, and the edge 44 extends between the edges 46 and 48, remote from the curved edge 42. The square edges 34 and 44 may be considered as inner edges of the cushions, as discussed below.

The curved edge 42 is generally aligned with the curved edges 16 and 54 of the outer and inner layers 12 and 50, respectively.

As best shown in FIG. 4, but as may also be understood from FIG. 2, the insert elements 30 and 40 are generally disposed toward the outer or curved edges of the inner and outer layers, leaving a fold area 60 between the inner edges 34 and 44. The inner edges 34 and 44 are disposed towards each other, or face each other. They are separated by the fold area 60.

In FIG. 2 and 4, the center or inner fold area 60 is generally identified by a dash dot line on the inner layer 50. On the outer layer 12, the outer fold area is identified generally by reference numeral 62. See FIG. 3.

The outer and inner layers 12 and 50 are secured together at their outer peripheral edges by peripheral stitching 64. The cushion inserts 30 and 40 are disposed between the two layers, and the stitching is adjacent to the outer curved edges and the adjacent side edges of the insert elements. This is best shown in FIG. 4.

Referring particularly to FIGS. 1 and 2, there are secured to the inner layer 50 four fastening strips. The fastening strips include a first pair of aligned fastening strips 70 and 72, and a second pair of aligned fastening strips 74 and 76. The fastening strips 70. . . 76 are preferably of the "Velcro" or loop and hook type fasteners. For example, the strips 70 and 74 may be of the loop type fastener elements, while the fastening strips 72 and 76 may be of the hook type fastening strips. When the apparatus 10 is folded, along the fold areas 60 and 62, as shown in FIG. 3, the aligned and mated fastening strip pairs 70, 72, and 74, 76 are pressed together to secure the pad apparatus 10 in place.

The fold areas 60 and 62 essentially divide the apparatus 10 into two halves, a lower half 80 and an upper half 82. The terms "lower" and "upper" refer to the use position or orientation of the padded cushion apparatus 10, as shown in FIG. 3. The two half portions are in vertical alignment or juxtaposition in their use position or orientation, hence the generally symmetry of the two halves or two half portions 80 and 82 of the apparatus.

FIG. 3 illustrates the operation of the pad apparatus 10. In FIG. 3, a user's shoulder is indicated by reference numeral 2, and the user's neck is indicated by reference numeral 4. A bra strap is shown in dotted line identified by reference numeral 6. The bra strap 6 is also shown in FIG. 1. Referring accordingly to FIGS. 1 and 3, the pad and cushion apparatus 10 is placed on a user's shoulder, beneath the bra strap 6, and with the bra strap 6 disposed on the strips 74 and 70. The apparatus 10 is then folded along the lines 60 and 62 and the strips 72 and 76 are pressed onto the exposed portions of the strips 70 and 74, respectively. In this manner, the bra strap 6 is locked in place relative to the cushion apparatus 10, and the cushion apparatus 10 is held in place by the bra strap on the user's shoulder 2, with the fold lines 60 and 62 toward the shouler and the curved portions 14, 16 and 52, 54 toward the user's neck 4.

With the overall width between the straight edges 18, 56, and 20, 58 being relatively wide, or sufficient to extend generally fully across the user's shoulder, the apparatus 10 provides a cushion for the bra strap 6. At the same time, the apparatus 10 comprises a shoulder pad disposed at the outer edge of the user's shoulder, and beneath the shoulder portion of the blouse or dress worn by the user. The apparatus accordingly performs the dual function of cushioning a bra strap, for the benefit of the user, and the decorative or fashion objective of providing or comprising a shoulder pad. Or, phrased another way, the decorative or fashion type shoulder pad serves a second function of providing a cushion for the user beneath the bra strap. It will also be noted that the use of the folded apparatus, particularly with the top of upper cushion 30, substantially eliminates the potentiality of a "groove" forming beneath the bra strap on the lower or bottom half 80 and which groove could or may show through the upper half 80 and on a blouse or dress. On the other hand, it may be desirable to eliminate the top or upper cushion 30. In such case, the double thickness of the top half portions of the layers 12 and 50 may be sufficient to provide the shoulder pad function, along with the bottom half portions and only the bottom cushion 40.

Figure 5:
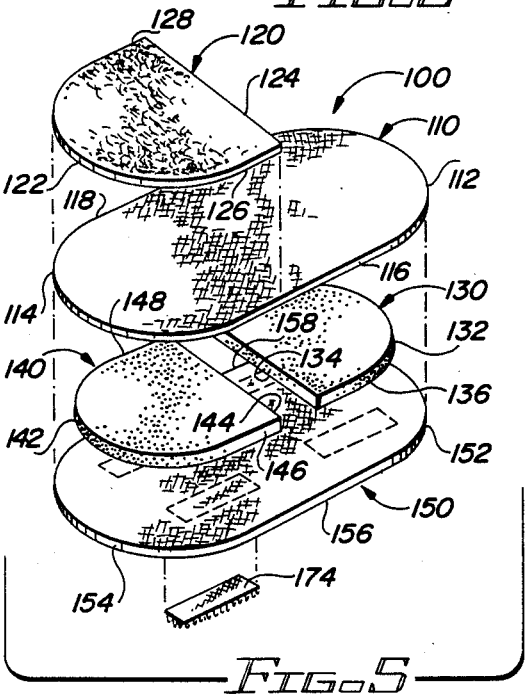
FIG. 5 is an exploded perspective view of an alternate embodiment of the apparatus of the present invention.
Figure 6:
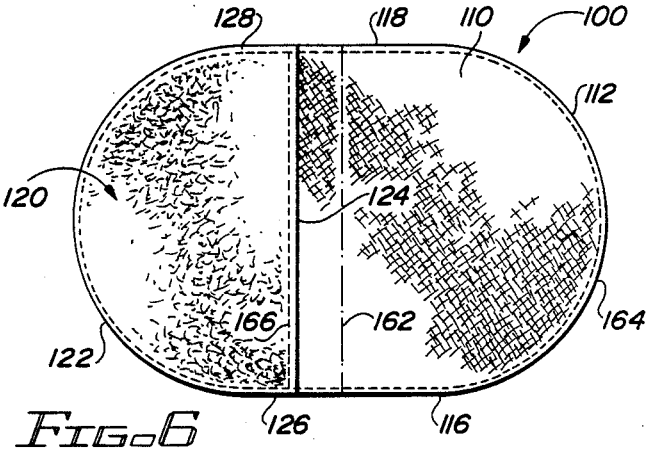
FIG. 6 is a bottom plan view of the apparatus of FIG. 5.
Figure 7:
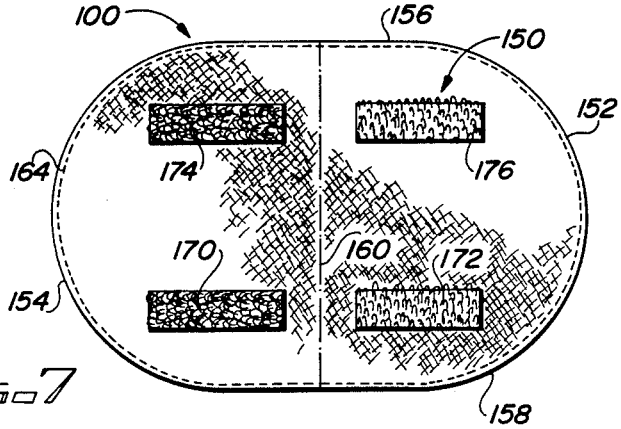
FIG. 7 is a top plan view of the apparatus of the present invention.

An alternate embodiment of the appatus 10 is illustrated in FIGS. 5, 6, and 7. FIG. 5 is an exploded perspective view of alternate pad and cushion apparatus 100. FIG. 6 is a plan view of the bottom of the apparatus 100 and FIG. 7 is a top plan view of the apparatus 100.

The cushion and pad apparatus 100 includes a bottom layer 110 having a pair of rounded edges, including a rounded edge 112 and a rounded edge 114. The rounded edges 112 and 114 extends to a pair of relatively straight side edges 116 and 118. The edges or sides 116 and 118 are generally parallel to each other.

Appropriately secured, as by stitching, to a portion of the layer 110, as will be discussed below, is a terry cloth bottom portion 120. The terry cloth bottom portion 120 includes a rounded outer edge 122 which is generally aligned with the rounded edge 114 of the bottom layer 110. The rounded outer edge 122 extends to a pair of straight side edges 126 and 128. A straight edge 124 extends between the side edges 126 and 128.

The terry cloth bottom portion 120 will be disposed against the shoulder of the user. It simply comprises a soft, absorbent bottom element or pad for the convenience of the user of the apparatus 100.

The apparatus 100 also includes an inner layer 150, which is again substantially the same size and dimension as the outer layer 110. The inner layer 150 includes a pair of rounded edges 152 and 162, with a pair of side edges 156 and 158 disposed between the outer edges 152 and 154. The edge 156 is generally parallel to the edge 116 of the outer layer 112, and the edge 158 is generally parallel to and aligned with the outer edge 118 of the outer layer 112.

Between the outer layer 112 and the inner layer 150 is a pair of foam cushion elements 130 and 140. The cushion element 130 includes a rounded edge 132 which extends to a pair of straight side edges. The side edge 136 is shown in FIG. 5 . The straight edges extend to an inner edge 134. The cushion 140 includes an outer rounded edge 142 and an inner straight edge 144. The curved outer edge 142 extends to a pair of side edges 146 and 148, which are aligned with the respective side edges of the cushion insert 130. The inner, straight edge 144 extends between the outer edges 146 and 148.

The outer layer 112 and the inner layer 150 are appropriately secured together, as by stitching, with the foam cushion elements 130 and 140 disposed between them, all as discussed above in conjunction with the pad or cushion apparatus 100. The terry cloth bottom layer 120 is secured only to one portion or half of the outer layer 112, as best illustrated in FIG. 6. The layers are secured together, and the terry cloth layer is also secured, at its outer periphery, by peripheral stitching 164. The terry cloth layer includes inner stitching 166 along its inner edge 124. The stitching 166 preferably extends to the peripheral stitching 164.

It will be noted that the apparatus 100, like the apparatus 10, is symmetrical and thus is divided into two halves, by a pair of fold lines 160 and 162. The fold line 160 comprises an inner fold line and the fold line 162 comprises an outer fold line.

As best shown in FIG. 6, the terry cloth layer 120 has an overall length, i.e., the distance between its outer curved edge 122 and its inner straight edge 124, which is slightly less than the length of half of the bottom layer 110, of the distance between the outer curved edge 114 and the fold line 162.

On the inner layer 150 are hook and loop fastening element pairs, which are substantially identical to the fastening elements 70. . . 76. The fastening elements on the inner layer 150 include a pair of looped type "Velcro" type fasteners 170 and 174, and an aligned pair of hook type "Velcro" type hook fasteners 172 and 176. When the halves of the apparatus 100 are folded over, the aligned hook and loop fastener strips 170 and 172 mate with each other and the aligned loop and hook fastener strips 174 and 176 matingly engage each other to secure a bra strap to the apparatus 100 and in turn secure the apparatus 100 to the user. Thus, the apparatus 100 functions in substantially the same way as does the apparatus 10.

Referring again primarily to FIG. 3, but as will also be understood from FIGS. 1, 4, 6, and 7, the fold lines for the apparatus are generally straight between the side edges of the various panels. When folded and in their use position, the outer fold lines, such as the fold line 62 of FIG. 3, comprises a straight outer edge and defines the outer edge of the shoulder pad aspect of the apparatus 10. The outer straight edge 62 is, naturally, disposed on the outer portion of the user's shoulder 2, remote from the user's neck 4.

In the embodiments discussed above, peripheral stitching 64 and 164 has been referred to and is shown in the drawings. It is obvious that appropriate edge binding could be used instead of the stitching. Some advantages of such binding include not only appearance but also function in terms of substantially eliminating the possibility of fraying, etc.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifiations, within the limits only of the true spirit and scope of the invention.

What I claim is:

1. Shoulder pad and bra strap cushion apparatus, comprising, in combination:

outer layer means including a first half portion and second half portion, including a pair of spaced apart side edges and a pair of spaced apart and generally rounded outer edges extending between the side edges;

inner layer means having substantially the same configuration and dimensions as the outer layer and including a first half portion and a second half portion, the outer layer means and inner layer means adapted to be folded in half to align the first and second half portions in vertical alignment with the rounded outer edges aligned and disposed against each other and the fold defining a generally straight line;

cushion means disposed between the outer and inner layer means; and fastening means secured to the inner layer means for securing together the first and second half portions in their vertical alignment and to secure the bra strap between the first and second half portions, with the rounded outer edges adapted to be disposed towards a user's neck and the fold adapted to be disposed towards the user's shoulder to comprise a shoulder pad and a bra strap cushion.

2. The apparatus of claim 1 in which the cushion means is disposed between the first half portions of the outer and inner layer means, and the bra strap is disposed on top of the first half portions.

3. The apparatus of claim 1 in which the cushion means includes a first cushion portion between the first half portions and a second cushion portion between the second half portions.

4. The apparatus of claim 1 in which the outer and inner layer means each comprise a generally symmetrical layer having substantially the same dimensions.

5. The apparatus of claim 1 in which the outer layer means includes an absorbent portion secured to the first half portion and adapted to be disposed against the user's shoulder.

6. The apparatus of claim 1 in which the fastening means includes a first portion secured to the first half portion and a second portion secured to the second half portion.

7. The apparatus of claim 6 in which the fastening means further includes a third portion secured to the first half portion and a fourth portion secured to the second half portion.

8. The apparatus of claim 6 in which the first and second portions are adapted to contact the bra strap to lock the bra strap in place.

* * * * *